US010421088B2

(12) United States Patent
Schübel et al.

(10) Patent No.: US 10,421,088 B2
(45) Date of Patent: Sep. 24, 2019

(54) DEVICE FOR COATING CYLINDER WALLS

(71) Applicants: BAYERISCHE MOTOREN WERKE AKTIENGESELLSCHAFT, München (DE); TECHNISCHE UNIVERSITÄT MÜNCHEN, München (DE)

(72) Inventors: Martin Schübel, Ergoldsbach (DE); Wolfram Wagener, Geisenhausen (DE); Patrick Woisetschlaeger, Straubing (DE)

(73) Assignees: BAYERISCHE MOTOREN WERKE AKTIENGESELLSCHAFT, München (DE); TECHNISCHE UNIVERSITÄT MÜNCHEN, München (DE)

( * ) Notice: Subject to any disclaimer, the term of this patent is extended or adjusted under 35 U.S.C. 154(b) by 0 days.

(21) Appl. No.: 14/914,075

(22) PCT Filed: Jul. 31, 2014

(86) PCT No.: PCT/EP2014/002115

§ 371 (c)(1),
(2) Date: Feb. 24, 2016

(87) PCT Pub. No.: WO2015/028116

PCT Pub. Date: Mar. 5, 2015

(65) Prior Publication Data

US 2016/0207056 A1 Jul. 21, 2016

(30) Foreign Application Priority Data

Aug. 26, 2013 (DE) ..... 10 2013 014 174

(51) Int. Cl.
*B05B 9/00* (2006.01)
*B05B 13/06* (2006.01)
(Continued)

(52) U.S. Cl.
CPC ..... *B05B 9/002* (2013.01); *B05B 12/20* (2018.02); *B05B 13/06* (2013.01);
(Continued)

(58) Field of Classification Search
None
See application file for complete search history.

(56) References Cited

U.S. PATENT DOCUMENTS 4,108,382 A * 8/1978 Ryd ..... B05B 9/01 118/317
4,226,213 A * 10/1980 Bernauer ..... F01P 9/00 123/1 A
(Continued)

FOREIGN PATENT DOCUMENTS

CN 1330728 A 1/2002
CN 101553592 A 10/2009
(Continued)

*Primary Examiner* — Jethro M. Pence
(74) *Attorney, Agent, or Firm* — DeLio Peterson & Curcio LLC; Robert Curcio

(57) ABSTRACT

A device for coating cylinder walls of an internal combustion engine forming a plurality of cylinders. A coating device is provided for each cylinder, the coating devices are controlled in such a way that the cylinder walls of all the cylinders are coated simultaneously.

6 Claims, 1 Drawing Sheet

(51) Int. Cl.

| | |
|---|---|
| ***F02F 1/00*** | (2006.01) |
| ***B05B 12/20*** | (2018.01) |
| ***C23C 4/12*** | (2016.01) |
| *B05B 7/16* | (2006.01) |
| *B05D 1/00* | (2006.01) |
| *B05D 1/02* | (2006.01) |

(52) U.S. Cl.
CPC ..... *B05B 13/0636* (2013.01); *C23C 4/12* (2013.01); *F02F 1/004* (2013.01); *B05B 7/1606* (2013.01); *B05D 1/002* (2013.01); *B05D 1/02* (2013.01)

(56) References Cited

U.S. PATENT DOCUMENTS

| | | | |
|---|---|---|---|
| 5,245,153 | A | 9/1993 | Singer |
| 5,380,564 | A | 1/1995 | VanKuiken, Jr. et al. |
| 5,468,295 | A | 11/1995 | Marantz et al. |
| 5,714,205 | A | 2/1998 | Marantz et al. |
| 5,863,408 | A | 1/1999 | Ikegaya |
| 5,976,704 | A | 11/1999 | McCune |
| 6,703,579 | B1 | 3/2004 | Rice |

FOREIGN PATENT DOCUMENTS

| | | | | | |
|---|---|---|---|---|---|
| CN | 102712989 | A | | 10/2012 | |
| DE | 3722223 | | | 7/1987 | |
| DE | 19910578 | | | 6/2000 | |
| DE | 102010060652 | | | 11/2010 | |
| EP | 1152139 | | | 11/2001 | |
| EP | 1714704 | A1 | | 10/2006 | |
| JP | 2005199201 | A | | 7/2005 | |
| WO | 2000037705 | A1 | | 6/2000 | |
| WO | WO 00/37705 | | * | 6/2000 | ..... C23C 4/16 |

* cited by examiner

DEVICE FOR COATING CYLINDER WALLS

BACKGROUND OF THE INVENTION

1. Field of the Invention

The invention relates to a device for coating cylinder walls of an internal combustion engine forming a plurality of cylinders.

2. Description of Related Art

For reasons of weight, internal combustion engines in motor vehicles are regularly designed with an engine block made of light metal, in particular aluminum. However, it can prove problematic here that, due to the tribological properties of the light metal, in particular the comparatively poor resistance to wear, the inner walls of the cylinders formed by the engine block are only inadequately suitable as running surfaces for the pistons.

In order to avoid these problems, in many internal combustion engines with an engine block made of light metal cylinder liners made of, for example, grey cast iron are used, as a result of which the advantages of the light metal (low specific weight) can be combined with those of the grey cast iron (good tribological properties).

Alternatively, it is known for the running surfaces of the light metal engine blocks to be provided with a coating in order to realize the desired tribological properties for the running surfaces. Such a coating is regularly realized by melting the coating material and spraying it onto the cylinder walls.

A variety of different coating methods are known, with thermal coating methods, in which the coating material is melted and then—usually by means of a compressed air or other gas flow—atomized and transported onto the surface which is to be coated, being used in particular. Known thermal coating methods include, for example, plasma coating, high velocity oxy-fuel spraying and wire arc spraying.

A device for wire arc spraying is for example known from DE 198 41 617 A1. The device disclosed therein is based on a spray lance which is driven so as to rotate around its own axis and at the same time is advanced in the direction of the longitudinal axis, so that this can penetrate to varying depths into the cylinder which is to be coated. The spray jet of coating material generated by the spray head of the spray lance is thus applied to the cylinder wall in question in a helical movement.

In the known coating methods for cylinder walls of an internal combustion engine, the coating of the individual cylinders takes place in succession. In particular, this allows the complexity of construction and thus the costs of the coating installation to be kept low. However, one disadvantage here is the relatively long processing time which is necessary in order to coat all the cylinders of a multiple-cylinder internal combustion engine.

SUMMARY OF THE INVENTION

Starting out from this prior art, the invention was based on the problem of providing a possible way of producing a high-quality coating on cylinder walls of a multiple-cylinder internal combustion engine with the shortest possible processing time.

This problem is solved through a device according to the independent claims. Advantageous embodiments of the device according to the invention are the subject matter of the dependent claims and are explained in the following description of the invention.

The above and other objects, which will be apparent to those skilled in the art, are achieved in the present invention which is directed to an apparatus for coating cylinder walls of an internal combustion engine forming a plurality of cylinders, the apparatus comprising a coating device for each of the plurality of cylinders, the coating device being actuated such that a simultaneous coating of the cylinder walls of all the cylinders takes place.

The coating devices are designed in the form of spray lances which are driven rotatingly by a common drive device. All the spray lances may be driven by the drive device by a belt drive.

The spray lances are connected in series, so that when the drive device is in operation each spray lance drives an adjacent spray lance rotatingly and/or is driven rotatingly by an adjacent spray lance.

The apparatus further includes gear drives formed between adjacent spray lances.

A cooling device may be included for cooling an engine block of the internal combustion engine forming the cylinders. The cooling device may apply a cooling fluid to the engine block.

The cylinders open onto a front surface of the engine block and the cooling device may include a cooling plate designed to lie against the front surface. The cooling plate may also include cooling channels for a cooling fluid. In one embodiment, the cooling plate at least partially covers the cylinder openings in the front surface.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
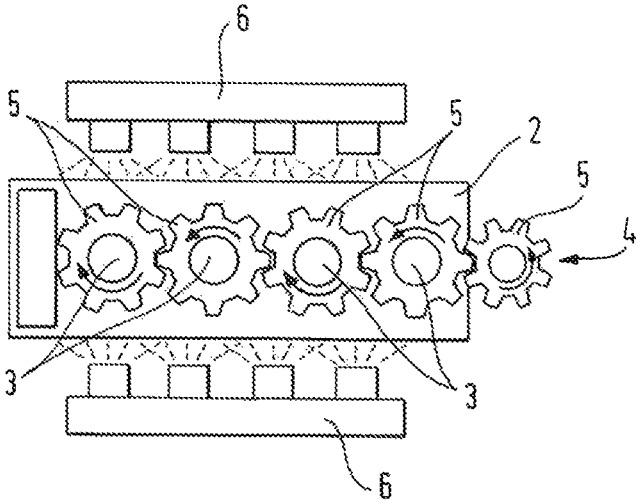
FIG. 1 shows the coating of an engine block by means of a device according to the invention according to a first embodiment, in a view from above.

In describing the preferred embodiment of the present invention, reference will be made herein to FIGS. 1-3 of the drawings in which like numerals refer to like features of the invention.

A generic device for coating cylinder walls of an internal combustion engine fanning a plurality of cylinders is characterized by (at least) one coating device for each of the cylinders, said coating devices being actuated such that (at least at times) a simultaneous coating of all the cylinder walls takes place.

Using a device according to the invention, the cylinder walls of an engine block, in particular an engine block of the internal combustion engine, can be coated in a short processing time which can, in particular, be only a fraction of the processing time which would be associated with a previously usual individual processing of the cylinders. The reduction in the processing time can be all the greater the greater the number of cylinders (for example four or six) which are formed in the engine block.

In addition to shortening the processing time for a multiple-cylinder engine block, the use of the device according to the invention can display further advantages, since it has been recognized that an inhomogeneous distribution of stresses within the engine block results through the sequential coating of the individual cylinders of a multiple-cylinder engine block. This is brought about by the uneven heating and cooling of the individual cylinders (for example, due to the absorption of heat through the preceding coating operation, the second cylinder wall which is to be coated is, at the beginning of its being coated, already at a higher temperature level than the first cylinder wall was at the beginning of its coating). Through the heat which is transmitted into the engine block through the coating process, thermal deformations occur with sequential coating which, due to the inhomogeneous distribution of heat, are correspondingly inhomogeneous in their distribution. Following cooling, the inhomogeneous thermal deformations lead to inhomogeneous distribution of stresses within the engine block and the coating. This can have a negative influence on the further processing and the service life of the engine block. When coating is carried out by means of a device according to the invention, with the simultaneous processing of all the cylinders a more even absorption of heat into the engine block is achieved, since the coating process for all the cylinder walls starts at the same temperature level. Coating by means of a device according to the invention can thus lead to the most homogeneous possible distribution of stresses within the engine block and the coatings, which can have a positive effect on the further processing of the engine block and on its service life.

The simultaneous coating of all the cylinders according to the invention can lead to a considerable absorption of heat into the engine block. In order to prevent this having a negative effect on the engine block and/or the coatings, in a preferred embodiment of the device according to the invention a cooling device is provided in order to cool the engine block. This allows the thermal energy introduced through the coating process to be drawn off again from the engine block to an adequate extent.

Preferably, the cooling device can comprise a cooling means for applying a cooling fluid (for example air, water, oil, an emulsion, etc.) to the engine block. In particular, the outer surfaces of the engine block running along the longitudinal axes of the cylinders can be cooled in this way.

Also preferably, it can be the case that (at least) a front surface of the engine block, onto which the cylinders open, is cooled by means of a cooling plate which is preferably designed to lie against the front surface. The cooling effect of the cooling plate can preferably be attributable to a cooling fluid flowing through the cooling plate, for which purpose this can form corresponding cooling channels which are integrated into a cooling circuit for the cooling fluid.

If the cooling plate also at least partially covers the cylinder openings in the front surface, a so-called "overspray" can also be prevented by means of the cooling plate. This refers to coating particles or droplets escaping from the cylinders during the coating process which are deposited on component surfaces which are not intended to be coated. If necessary, openings can be provided in the cooling plate through which the coating devices can be inserted into the cylinders. The dimensions of the openings should thereby substantially correspond to the external diameters of the corresponding sections of the coating devices in order to achieve a good containing effect for the coating droplets by ensuring the smallest possible gap between the cooling plate and the spray devices. At the same time, the gap should be large enough to permit a relative movement between the coating devices and the cooling plate.

In a preferred embodiment of the device according to the invention, the coating devices can be designed in the form of spray lances which can be driven rotatingly (directly or indirectly) by a common drive device.

It can thereby be the case that, on activation of a drive device, the spray lances are driven in series, so that each spray lance drives an adjacent spray lance rotatingly and/or is driven rotatingly by an adjacent spray lance. The rotating drive between two adjacent spray lances can thereby be effected by means of a gear drive. In a constructively simple and therefore economical embodiment, each of the spray lances can for this purpose be connected non-rotatingly with a gear wheel, said gear wheels meshing with the gear wheels of adjacent spray lances. This would involve a reversal of the direction of rotation between adjacent spray lances. If such a reversal of the direction of rotation is to be avoided, this can be achieved simply through the integration in each case of an intermediate gear wheel between the gear wheels of adjacent spray lances.

In contrast, in a further preferred embodiment of the device according to the invention, all of the spray lances can be driven directly, i.e., without the interconnection of adjacent spray lances, by means of a belt drive, in particular a toothed belt drive of the drive device. This design variant would, in its simplest embodiment, involve all of the spray lances having the same direction of rotation, with embodiments with differing directions of rotation also being possible.

Figure 2:
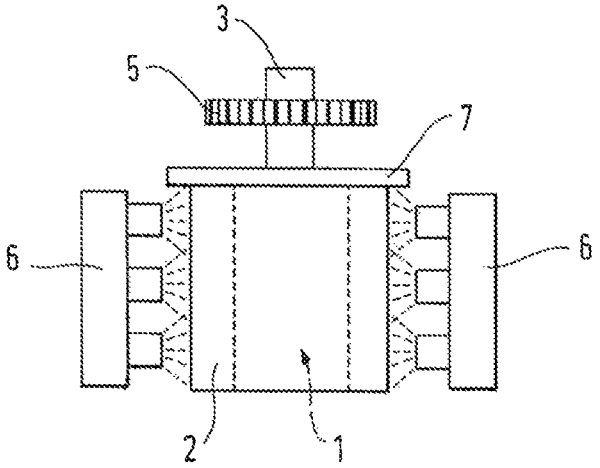
FIG. 2 shows the engine block with the device according to the invention as shown in FIG. 1 in a front view.

FIGS. 1 and 2 show, in diagrammatic form, a first embodiment of a coating device according to the invention which is designed and used for the simultaneous coating of the cylinder walls of four cylinders 1 of an engine block 2 of an internal combustion engine.

According to the drawing, the engine block 2 forms four cylinders 1 arranged in a row, the longitudinal axes of which are aligned parallel to one another. In each case, a spray lance 3 can be inserted into each of the cylinders 1 and can be moved along the longitudinal axis of the corresponding cylinder 1. The spray lances 3 can be driven rotatingly by means of a drive device 4, the rotating drive of the spray lances 3 being implemented with a series connection. Accordingly, both the drive device 4 and each of the spray lances 3 are equipped with a gear wheel 5, wherein the gear wheels 5 of adjacent spray lances 3 and the gear wheel 5 of the drive device 4 mesh with that of the adjacent spray lance 3. Accordingly, the drive device 4 only drives the spray lance 3 adjacent to it directly, the latter in turn driving the spray lance 3 adjacent to it. This continues until the last spray lance 3. As a result of the simple gears, each consisting of two gear wheels 5, which are formed between the reciprocally driven spray lances, a change in the direction of rotation takes place between adjacent spray lances 3.

Coating material is, for example, applied to the cylinder walls by means of thermal coating, so that the coating material is first melted and then—for example by means of a flow of compressed air or other gas—atomized and transported onto the surface which is to be coated. For this purpose, the spray lances 3 can have correspondingly designed spray heads (not shown) on their ends which are inserted into the cylinders 1.

During thermal coating, a not inconsiderable amount of heat is transmitted into the engine block 2. In order to prevent the engine block 2 from heating up excessively during the coating process, a cooling device is provided. This comprises two cooling units 6, which are arranged on the two longitudinal sides of the engine block 2 and which spray the corresponding outer surfaces of the engine block 2 with a cooling fluid. The cooling device also includes a cooling plate 7, which is laid on the front surface of the engine block 2 through which the spray lances 3 are inserted into the cylinder 1 (see FIG. 2). The cooling plate 7 thereby forms through-openings through which the spray lances 3 can pass in order to be inserted into the cylinder 1. These through-openings are only slightly larger in diameter than the spray lances 3, which are circular in cross section, and are thus smaller than the cylinders 1. Consequently, the cooling plate 7 simultaneously acts as a mask which largely prevents coating droplets from escaping from the cylinders 1. A corresponding cooling plate can also be arranged on the second front surface of the engine block 2. This can be designed without through-openings.

Figure 3:
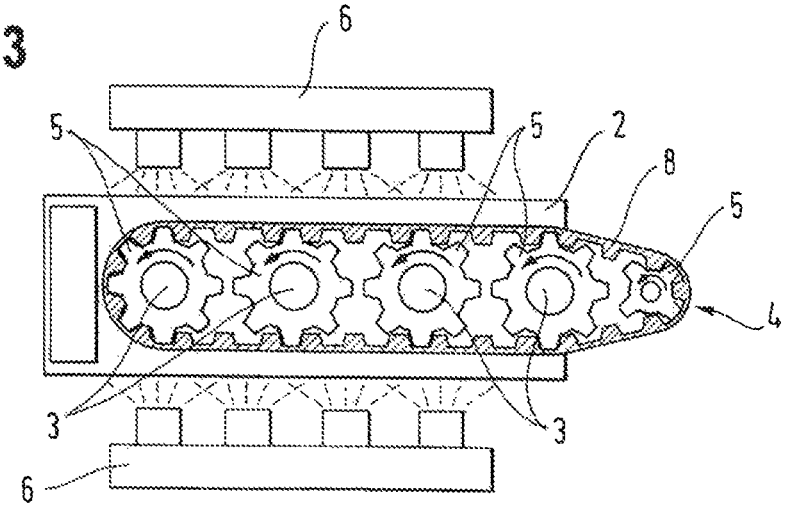
FIG. 3 shows the coating of an engine block by means of a device according to the invention according to a second embodiment, in a view from above.

The embodiment of a coating device according to the invention represented in diagrammatic form in FIG. 3 only differs from the embodiment described above in terms of the drive for the spray lances 3. In this case a toothed belt drive 8 is provided which transmits the driving force directly from the drive device to all the spray lances 3.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for coating cylinder walls of an internal combustion engine forming a plurality of cylinders, said apparatus comprising a coating device for each of said plurality of cylinders, said coating devices being actuated so that a simultaneous coating of the cylinder walls of all the cylinders takes place, wherein the coating devices are designed in the form of spray lances which are driven rotatingly by a common drive, wherein the apparatus further comprises a first cooling plate with cooling channels for a cooling fluid flowing through the first cooling plate for cooling a first front surface of an engine block of the internal combustion engine, and wherein the cylinders open onto the first front surface of the engine block and the first cooling plate lies against the first front surface, wherein the first cooling plate forms through-openings through which the spray lances pass in order to be inserted into the cylinders, and wherein the apparatus further comprises a second cooling plate corresponding to the first cooling plate but designed without through-openings and being arranged on a second front surface of the engine block.

2. The apparatus of claim 1, wherein the spray lances are connected in series, so that when the common drive is in operation each spray lance drives an adjacent spray lance rotatingly and/or is driven rotatingly by an adjacent spray lance.

3. The apparatus of claim 2, including gear drives formed between adjacent spray lances.

4. The apparatus of claim 1, wherein all the spray lances are driven by a belt drive or a gear drive.

5. The apparatus of claim 1, wherein the first cooling plate at least partially covers the cylinder openings in the first front surface.

6. An apparatus for coating cylinder walls of an internal combustion engine forming a plurality of cylinders, said apparatus comprising a spray lance for each of said plurality of cylinders, said spray lances being actuated so that a simultaneous coating of the cylinder walls of all the cylinders takes place, wherein the spray lances are driven rotatingly by a common drive, wherein the apparatus further comprises a first cooling plate with cooling channels for a cooling fluid flowing through the first cooling plate for cooling a first front surface of an engine block of the internal combustion engine, wherein the cylinders open onto the first front surface of the engine block and the first cooling plate lies against the first front surface, wherein the first cooling plate forms through-openings through which the spray lances pass in order to be inserted into the cylinders, and wherein the apparatus further comprises a second cooling plate corresponding to the first cooling plate but designed without through-openings and being arranged on a second front surface of the engine block.

* * * * *